US008726519B2

(12) United States Patent
Clarke et al.

(10) Patent No.: US 8,726,519 B2
(45) Date of Patent: May 20, 2014

(54) RAZOR CARTRIDGE

(75) Inventors: Sean Peter Clarke, Oxon (GB); Mathias Gester, Farnborough (GB); Michael Joseph Kwiecien, Scituate, MA (US)

(73) Assignee: The Gillette Company, Boston, MA (US)

( * ) Notice: Subject to any disclaimer, the term of this patent is extended or adjusted under 35 U.S.C. 154(b) by 439 days.

(21) Appl. No.: 13/039,828

(22) Filed: Mar. 3, 2011

(65) Prior Publication Data

US 2012/0030945 A1 Feb. 9, 2012

(51) Int. Cl.
*B26B 21/44* (2006.01)
*B26B 21/22* (2006.01)

(52) U.S. Cl.
USPC ..... 30/41; 30/50

(58) Field of Classification Search
USPC ..... 30/41, 50
See application file for complete search history.

(56) References Cited

U.S. PATENT DOCUMENTS

| | | | | |
|---|---|---|---|---|
| 4,624,051 | A * | 11/1986 | Apprille et al. | 30/50 |
| 4,683,096 | A | 7/1987 | Ferraro | |
| 4,697,342 | A * | 10/1987 | Ferraro | 30/41 |
| 5,410,810 | A * | 5/1995 | Gillibrand | 30/41 |
| 5,915,791 | A * | 6/1999 | Yin et al. | 30/41 |
| 6,161,287 | A * | 12/2000 | Swanson et al. | 30/50 |
| 6,216,345 | B1 * | 4/2001 | Andrews | 30/50 |
| 6,378,211 | B1 * | 4/2002 | McCool et al. | 30/50 |
| 6,473,970 | B1 * | 11/2002 | Prochaska | 30/41 |
| 6,655,030 | B2 * | 12/2003 | Zuidervaart | 30/50 |
| 7,331,107 | B2 * | 2/2008 | Follo et al. | 30/50 |
| 8,336,212 | B2 * | 12/2012 | Bozikis et al. | 30/50 |
| 2002/0092173 | A1 * | 7/2002 | Zuidervaart et al. | 30/34.2 |
| 2002/0157259 | A1 * | 10/2002 | Coffin | 30/50 |
| 2003/0159291 | A1 * | 8/2003 | Clark | 30/50 |
| 2004/0177511 | A1 * | 9/2004 | Miyazaki et al. | 30/50 |
| 2006/0100126 | A1 * | 5/2006 | Avery et al. | 510/475 |
| 2007/0151108 | A1 * | 7/2007 | Westerhof et al. | 30/50 |
| 2007/0227006 | A1 * | 10/2007 | Aviza et al. | 30/41 |
| 2011/0099815 | A1 * | 5/2011 | Burgio et al. | 30/41 |
| 2012/0094003 | A1 * | 4/2012 | Kwiecien et al. | 427/2.1 |
| 2012/0094006 | A1 * | 4/2012 | Kwiecien | 427/2.1 |
| 2012/0102741 | A1 * | 5/2012 | Pesikov | 30/41 |

FOREIGN PATENT DOCUMENTS

| | | | |
|---|---|---|---|
| EP | 0 254 490 | A1 | 1/1988 |
| EP | 0 276 094 | A2 * | 1/1988 |

* cited by examiner

*Primary Examiner* — Hwei C Payer
(74) *Attorney, Agent, or Firm* — Blaine A. Page; Kevin C. Johnson; Steven W. Miller

(57) ABSTRACT

A wet shaving cartridge is provided having a housing having a guard located at a front end of the housing and a cap located at a rear end of the housing. The cartridge further has two or more elongate blades located between the guard and cap and extending in a direction substantially parallel to a length of the guard, wherein edges of the respective blades lie in a shaving plane extending between the guard and the cap. A shaving aid retention member is located in the cap. The retention member has a base arranged to receive a shaving aid and a front wall located at a side of the retention member adjacent the blades. The front wall extends from the base of the retention member towards the shaving plane.

10 Claims, 4 Drawing Sheets

RAZOR CARTRIDGE

FIELD OF THE INVENTION

The present invention relates to a wet shaving razor cartridge having a retention member for receiving a shaving aid, the retention member having a front wall, the front wall extending from a base of the retention member towards a shaving plane of the razor cartridge.

BACKGROUND OF THE INVENTION

Wet shaving razors have evolved over the years to include a multiplicity of blades, guards and caps with lubricant strips, all with the goal of increasing the closeness of a shave while also providing a comfortable shaving experience.

In razor cartridges manufactured and sold by The Gillette Company, a lubricating strip is typically provided at the back of the cartridge, after the blades. Such a lubricating strip may comprise skin conditioning agents that improve the appearance and sensation encountered by the shaver upon completion of the shaving stroke. The lubricating strip may comprise a shaving enhancement product such as a lubricant. Razor cartridges comprising lubricating strips formed of polystyrene (PS) porous rigid matrices containing poly-ethyleneoxide (PEO) are known. These lubricating strips are typically snap-fit directly into the frame of the cartridge.

The rigid structure of the PS serves to provide a skin supporting surface at the back of the razor cartridge to prevent skin from being pushed low onto and between the blades. However, over time, the PEO leaches out of the PS matrix leaving behind just the matrix. The porous structure that is left behind can result in an uncomfortable shave due to the lack of lubrication and the scratchy sensation the matrix causes when brushed against skin. Further, the size of the matrix typically varies significantly through the course of multiple shaves—initially increasing in volume as the lubricating strip is exposed to water and subsequently reducing in size as the PEO leaches out. This variation in size can affect the general dynamics of the shave when the razor cartridge is used such that after a number of shaves, the razor cartridge is not as comfortable to use.

The present invention seeks to provide an alternative means of placing shaving aid on a razor cartridge while additionally providing more consistent dynamics in the shave.

SUMMARY OF THE INVENTION

The present invention relates to a wet shaving cartridge comprising a) a housing having a guard located at a front end of the housing and a cap located at a rear end of the housing, b) one or more elongate blades located between the guard and cap and extending in a direction substantially parallel to a length of the guard, wherein edges of the respective blades lie in a shaving plane extending between the guard and the cap, a shaving aid retention member located in the cap, the retention member having a base arranged to receive a shaving aid and a front wall located at a side of the retention member adjacent the blades, the front wall extending from the base of the retention member towards the shaving plane.

The retention member provides a platform on which shaving aid can be located. This allows for flexibility in the type/form of shaving aid. When in use, it is anticipated that the quantity of shaving aid provided on a razor cartridge will decrease. The front wall of the retention member provides a minimum amount of consistency in terms of blade geometry.

BRIEF DESCRIPTION OF THE DRAWINGS

Embodiments of the invention will hereinafter be described, by way of example, with reference to the accompanying drawings, in which.

DETAILED DESCRIPTION OF THE INVENTION

The invention is applicable to razor cartridges in general that are used in a wet shaving system.

Figure 1:
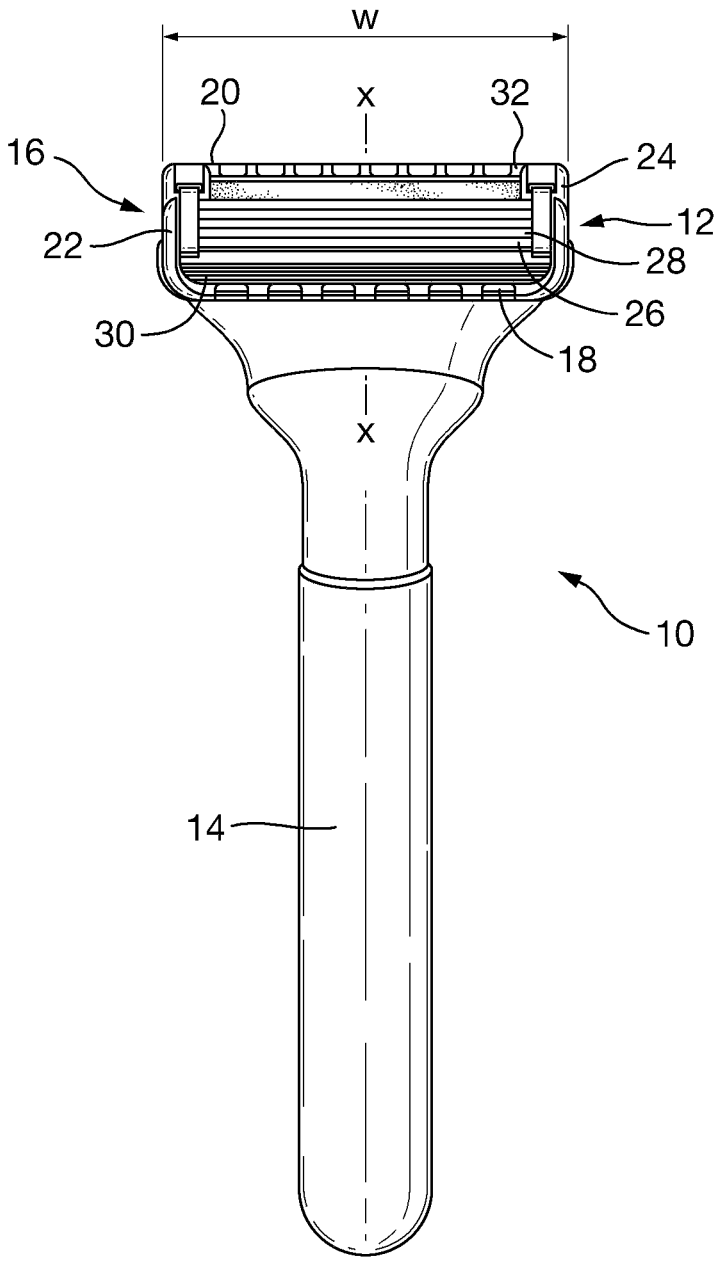
FIG. 1 is a front view of one possible embodiment of a wet shaving razor.

FIG. 1 shows a wet shaving razor 10 formed of a razor cartridge 12 attached to a handle 14. The razor cartridge 12 is formed of a housing 16 having a front wall 18, a rear wall 20 and first and second opposing side walls 22, 24 disposed transverse to and between the front wall 18 and rear wall 20. Two of more blades 26 with sharp cutting edges 28 are mounted within the housing 16 and extend between the first and second opposing side walls 22, 24. The tangent between cutting edges 28 of the first 62 and last 64 blade defines a shaving plane A (shown in FIGS. 2 and 3) between the guard and the cap. Four blades are shown in the embodiment of FIG. 1, however, it will be understood that more or fewer blades may be mounted within the housing 16.

The razor cartridge 12 further has a guard 30 located ahead of the blades and a cap 32 located after the blades. In the embodiment shown, the guard is disposed on the front wall of the housing and the cap is disposed on the rear wall of the housing. However, it will be appreciated that in an alternative embodiment, the guard may be formed separately to the housing and mounted directly to the razor handle 14, or formed as an entirely separate component and located between the handle and razor cartridge.

Figure 2:
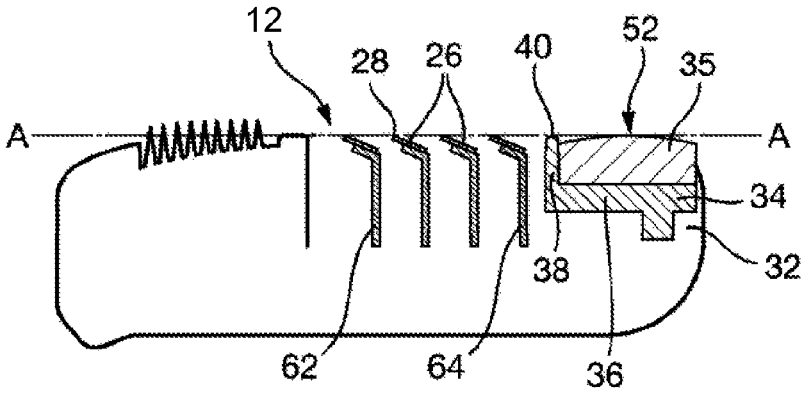
FIG. 2 is a schematic cross-sectional side-view through x-x of a possible embodiment of the razor cartridge shown in FIG. 1.

FIG. 2 shows a schematic cross-sectional side view through x-x of the razor cartridge of FIG. 1. The cap 32 is formed of a retention member 34 on which a shaving aid 35 may be disposed. The retention member 34 has a base 36 and a front wall 38 located at a side of the retention member adjacent the blades. In the embodiment shown in FIG. 2, the retention member 34 is shown to be a single L-shaped structure for receiving a shaving aid. However, it will be appreciated that that the retention member 34 could be formed in segments to result in two or more retention members, still having a base 36 and front wall 38. The retention member 34 is shown in embodiments to be a separate article located within the housing 16. However, it will be appreciated that the retention member 34 may be formed integrally with the housing 16 in alternative embodiments.

The position of an edge 40 of the front wall 38 relative to the shaving plane controls the amount of skin bulge that will be possible between the last blade 64 and the front wall 38. In embodiments, the edge 40 may be a distance, d, between 0, 0.05, 0.1, 0.15, 0.2 and 0.3, 0.35, 0.4 mm below the shaving plane A, while still reducing the amount of discomfort that may be caused to a user of the razor cartridge through skin bulge following the last blade 64. FIG. 2 shows an embodiment where d is 0 and the edge 40 lies in the shaving plane, A.

Figure 3:
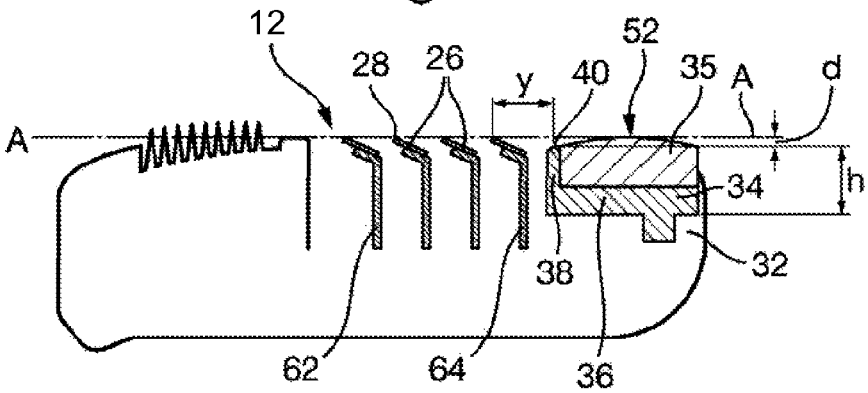
FIG. 3 is a cross-sectional view of an alternative embodiment of the razor cartridge shown in FIG. 2.

FIG. 3 shows an embodiment where d is approximately 0.4 mm and the edge 40 lies beneath the shaving plane.

Referring now to FIG. 3, the height, h, of the front wall 38 is determined by a depth of the razor cartridge. In embodiments, the height, h, is between 0.5, 1, or 1.5 and 2, 2.5, or 3 mm. The effect on skin bulge is also determined, in part, by the proximity of the edge 40 of the front wall 38 to the edge 28 of the last blade 64. In embodiments, the edge may be a distance, y, between 0.4, 0.5, 0.6 to 0.7, 0.8, 0.9 mm away from the edge 68 of the last blade 64.

A shaving aid 35 is disposed on the retention member 34, as shown in FIGS. 2 and 3. The shaving aid 35 may be a pre- or post-shaving aid intended to, for example, improve the appearance and sensation encountered by the shaver upon completion of a shaving stroke. By way of example, the shaving aid may be hydrophobic oil or a lipid based material (that is delivered to the surface being shaved by direct abrasion with the surface) or a hydrophilic water soluble material (that is delivered by dissolution). Shaving aids which can be used include those disclosed in U.S. Pat. Nos. 7,069,658, 6,944,952, 6,594,904, 6,182,365, 6,185,822, 6,298,558 and 5,113,585.

Use of the retention member 34 increases the flexibility in choice of shaving aid 35 that can be placed on the razor cartridge. For example, in some razor cartridges currently on the market, the chemistry has to be impregnated in a structured matrix, for example, poly-ethyleneoxide in a polystyrene matrix or a sponge. In the embodiment described herein, the retention member 34 provides the structure and a greater variety of chemical substances can be deposited on the base 36 of the retention member 34. In embodiments, the shaving aid is in a solid or semi-solid state and is preferably a material that can be poured onto the retention member and subsequently set, a material that can be pressed onto the retention member, or a material that can be prefabricated and bonded to the retention member.

In an embodiment, shown in FIG. 3, the shaving aid 35 may be thicker than the height of the front wall 38 such that a top surface 52 of the shaving aid 35 protrudes above the edge 40 of the front wall 38 of the retention member 34. In the embodiment shown in FIG. 2, the top surface 52 is in line with the edge of the front wall. For certain shaving aid materials, for example, PEO, it is likely that when the shaving aid interacts with water, it may increase in volume, thus causing the top surface 52 of the shaving aid to rise from its original position. In all embodiments, it is expected that as the razor cartridge is used repeatedly, shaving aid will be deposited on the surface being shaved and the volume of the shaving aid will decrease.

Regardless of the initial position of the top surface 52 of the shaving aid, as it recedes beneath the level of the edge 40 of the front wall 38, the front wall 38 maintains geometry with the blades, limiting the amount of skin bulge between the final blade and the retention member.

The base 36 of the retention member 34 has a generally rectangular or oval shape, and extends generally across the width, w (shown in FIG. 1), of the razor cartridge. In the embodiments shown in FIGS. 2 and 3, the front wall 38 and base 36 of the retention member 34 are shown to be perpendicular to one another. However, it will be appreciated that the front wall 38 could be set at a different angle relative to the base 36. Furthermore, the base 36 is shown to be substantially parallel to a top surface 58 of the razor cartridge. However, it will be appreciated that the base could be set at an angle relative to the top surface 52 of the shaving aid.

Figure 4:
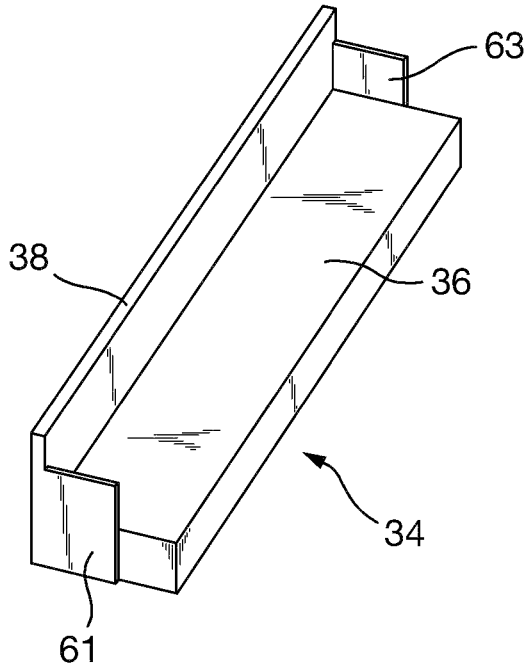
FIG. 4 is a perspective view of an embodiment of a retention member as shown in the razor cartridges of FIGS. 1 to 3.
Figure 5A:
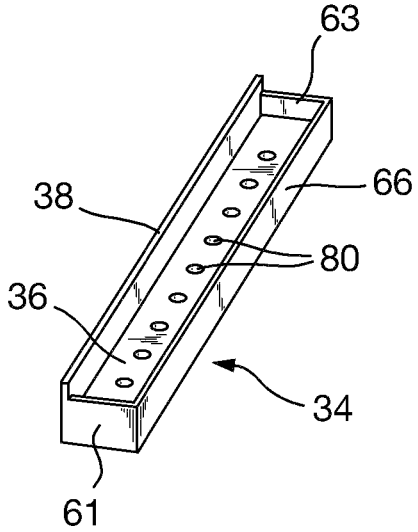
FIGS. 5 (*a*), (*b*) and 6 (*a*), (*b*), (*c*) show alternative embodiments of the retention member shown in FIG. 4.
Figure 5B:
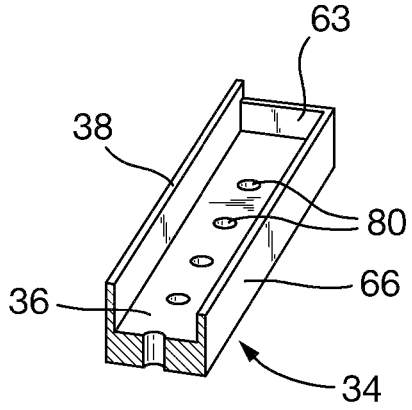
Figure 6A:
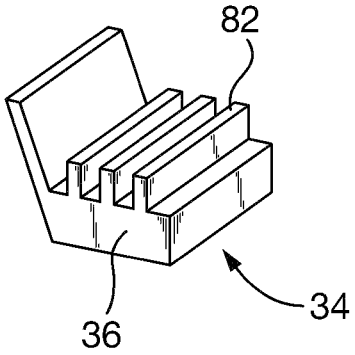
Figure 6B:
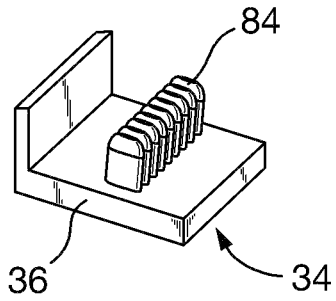
Figure 6C:
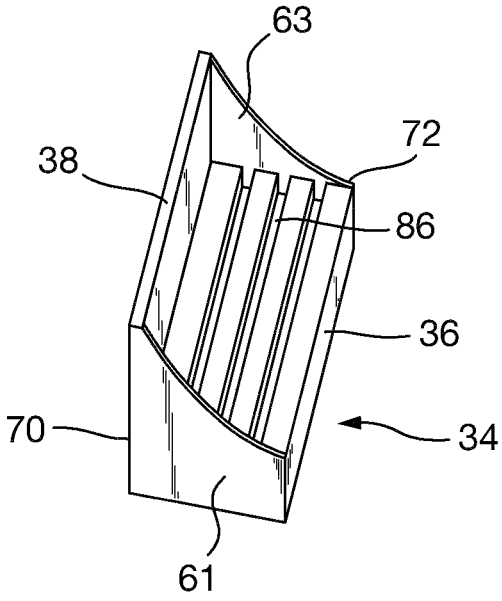

To retain the shaving aid 35 in position on the retention member 34, the retention member 34 may have side walls 61, 63 as shown in FIG. 4 and/or a back wall 66, shown in FIGS. 5(*a*) and (*b*). To ensure that, during use, it is possible to deposit the shaving aid on skin, the height of the side walls 61, 63 is less than that of the front wall 38. FIG. 6(*c*) shows side walls having gradually decreasing heights from a front end 70 of the retention member to a rear end 72 of the retention member 34. The side walls could have a straight top edge, be curved, or reduce in height in a stepped manor. Alternatively, the side walls may extend only partway along the sides of the retention member, as shown in FIG. 4. The back wall 66 is shown in FIG. 5(*b*) to be approximately half the height of the front wall 38 to enable contact between the shaving aid and the surface being shaved even after the shaving aid begins to recede.

Alternatively and/or additionally, (as shown in FIGS. 6(*a*), 6(*b*) and 6(*c*)) the base of the retention member may be provided with depressions (80), ridges (82), projections (84) or grooves (86) to retain positioning of a shaving aid that is subsequently located in the retention member. For example, FIGS. 5(*a*) and 5(*b*) show embodiments where the base 36 has one or more depressions 80 that extend part or all the way through the base 36. The shaving aid may be pressed or allowed to set into the depressions 80 such that the depressions 80 provide an anchor. This is particularly useful when the shaving aid is made wet or heated as the shaving aid may become slippery or soft. Alternatively, to anchor the shaving aid, the base of the retention member may be provided with projections or grooves on which the shaving aid can either be set or pressed. For example, FIGS. 6(*a*), 6(*b*) and 6(*c*) shows embodiments where the base 36 of retention member 34 is provided with spikes 84 or ridges 82 on which the shaving aid may be pressed or set.

The retention member may be made of semi-rigid polymeric material having a Shore A hardness of about 50, 60 or 70 to about 90, 110 or 120. In some embodiments, the retention member may be molded from the same material as the housing, for example, Noryl™ (a blend of polyphenylene oxide (PPO) and polystyrene). Alternatively, the retention member may be formed of thermoplastic elastomers (TPEs) or rubbers, examples of which include, but are not limited to: silicones, natural rubber, butyl rubber, nitrile rubber, styrene butadiene rubber, styrene butadiene, styrene (SBS) TPEs, styrene ethylene butadiene styrene (SEBS) TPEs. The retention member is made of material that is sufficiently wear resistant that even after multiple uses, the front wall of the retention member retains its initial geometry relative to the shaving plane.

At least the front wall of the retention member is formed of a material that is non-erodable under normal shaving conditions. Non-erodable materials include those that do not erode or deform under normal shaving conditions, such as being placed in a warm water bath (at 50° C.) for 1 minute, followed by being rubbed on a 5"×2" strip of full grain leather 20 times with 2 PSI of pressure applied to the sample material, including non-soluble materials where less than 5% by weight of the sample dissolves in a 100 ml 25° C. water bath under no agitation. Water-insoluble materials are detailed in U.S. Pat. No. 6,449,839.

In embodiments, as shown in FIGS. 2 and 3, the edge 40 of the front wall has a rounded profile to avoid discomfort to a person using the razor cartridge, particularly as the top surface of the shaving aid recedes beneath the level of the edge of the front wall.

As shown in FIG. 1, the wet shaving razor cartridges of the present invention may be mounted on a handle 14 with the intention that the entire razor should be discarded when the sharp edges 28 of the blades 26 have become dull. Alternatively, the wet shaving cartridges of the present invention may be detachably mounted to a handle 14 so that the cartridge may be replaced on the handle 14 when the blade edges 28 have lost the sharpness required for efficient shaving. In typical cartridges, the blades 26 are usually carried by the housing 12, which is generally a molded plastic frame, and the blades 26 may then be supported to move within the frame, either independently of each other or in unison, under forces imparted on the blades 26 by the skin during shaving. In one embodiment, for support within the housing, the blades 26 are mounted fixedly within slots in a blade retaining member. In another instance, the blades may be floatably mounted within the housing. Here, the plurality of blades is supported by one or more spring loaded blade retaining members where such blades are permitted to respond to the forces encountered during shaving.

In each embodiment of the invention, the level of comfort obtained with any given wet shaving razor cartridge is influenced strongly by the shaving geometry, which is the relative positioning of the skin contacting components. Important parameters of the shaving geometry include the blade exposure which is the distance by which the tip of the blade edge projects above, or is retracted below, a plane which is tangential to the skin contacting parts next in front and next behind the blade edge, the blade tangent angle (also known as the blade shaving angle) which is the angle at which the plane of the blade is inclined to a plane which is tangential to the guard and the cap surfaces (the tangent plane), and the blade span which is the distance by which the blade edge is spaced from the skin contacting element immediately in front of the blade edge, as seen in a plane which is tangential to the blade edge and the skin contacting element in front of it. A progressive blade exposure may be used in the present invention as detailed in U.S. Pat. No. 6,212,777.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving cartridge comprising:

a) a housing having a guard located at a front end of the housing and a cap located at a rear end of the housing, b) two or more elongate blades located between the guard and the cap and extending in a direction substantially parallel to a length of the guard, wherein edges of the respective blades lie in a shaving plane (A) extending between the guard and the cap;

c) a shaving aid retention member located in the cap, the retention member having a base arranged to receive a shaving aid and a front wall located at a side of the retention member adjacent the blades, the front wall extending from the base of the retention member towards the shaving plane (A), wherein the retention member further has a back wall located at an end of the retention member furthest from the blades, the back wall lower than the front wall, and side walls disposed at either end of the front wall and extending from the base of the retention member, the side walls lower than the front wall.

2. A cartridge as claimed in claim 1, wherein the front wall extends into the shaving plane (A).

3. A cartridge as claimed in claim 1, wherein at least the front wall of the retention member is formed of a non-erodable material.

4. A cartridge as claimed in claim 1, wherein at least the front wall of the retention member is formed of semi-rigid polymeric material.

5. A cartridge as claimed in claim 1, wherein an edge of the front wall has a rounded profile.

6. A cartridge as claimed in claim 1, wherein the base of the retention member has provided therein one or more depressions or grooves.

7. A cartridge as claimed in claim 1, wherein the base of the retention member has provided thereon one or more projections or ridges.

8. A cartridge as claimed in claim 1, further comprising a shaving aid located on the base of the retention member.

9. A cartridge as claimed in claim 8, wherein the shaving aid is a hydrophobic oil or a lipid based material.

10. A cartridge as claimed in claim 8, wherein the shaving aid is a hydrophilic water soluble material.

* * * * *